US006545436B1

(12) United States Patent
Gary

(10) Patent No.: US 6,545,436 B1
(45) Date of Patent: Apr. 8, 2003

(54) MAGNETIC CONTAINMENT SYSTEM FOR THE PRODUCTION OF RADIATION FROM HIGH ENERGY ELECTRONS USING SOLID TARGETS

(75) Inventor: Charles K. Gary, Palo Alto, CA (US)

(73) Assignee: Adelphi Technology, Inc., Palo Alto, CA (US)

( * ) Notice: Subject to any disclaimer, the term of this patent is extended or adjusted under 35 U.S.C. 154(b) by 0 days.

(21) Appl. No.: 09/722,097

(22) Filed: Nov. 24, 2000

Related U.S. Application Data

(60) Provisional application No. 60/167,424, filed on Nov. 24, 1999.

(51) Int. Cl.[7] ..... H05H 7/08; H05H 7/10; H05H 11/00

(52) U.S. Cl. ..... 315/507; 315/500; 315/501; 315/111.41; 315/111.61; 315/504

(58) Field of Search ..... 315/501, 500, 315/507, 504, 111.41, 111.61

(56) References Cited

U.S. PATENT DOCUMENTS 5,073,913 A * 12/1991 Martin ..... 378/34
5,680,018 A * 10/1997 Yamada ..... 315/500
6,057,656 A * 5/2000 Ohashi et al. ..... 315/503

* cited by examiner

*Primary Examiner*—Bruce Anderson
*Assistant Examiner*—Nikita Wells
(74) *Attorney, Agent, or Firm*—J. H. Smith

(57) ABSTRACT

The present invention includes a magnetic storage ring into which electrons or other charged particles can be injected from a point external to the ring and still subscribe a path, after injection, contained within the magnetic storage ring. The magnetic storage ring consists of purely static (permanent) magnetic fields. The particles pass one or more times through a solid target that causes the high energy charged particles to emit radiation and damps the momentum of the particles, so that they cannot escape the magnetic field, allowing them to be captured therein.

12 Claims, 3 Drawing Sheets

MAGNETIC CONTAINMENT SYSTEM FOR THE PRODUCTION OF RADIATION FROM HIGH ENERGY ELECTRONS USING SOLID TARGETS

This application claims the benefit of Prov. Appl. No. 60/167,424, filed Nov. 24, 1999.

BACKGROUND—Field of the Invention

This invention relates to charged particle storage rings and radiation sources, specifically to sources using radiation from the perturbation of relativistic charged particles. The invention provides a way to increase the total electron or charged particle flux available for use with radiating targets in a storage ring.

BACKGROUND—Prior Art

It has been considered by many that it is impossible to inject an electron into a magnetic storage ring from an external location without the use of time-varying, inhomogenous magnetic fields or synchrotron radiation. (D. W. Kerst and R. Server, *Phys. Rev.,* vol. 60, pp.53–58, 1941.) An electron or other charged particle launched into a static magnetic field from a point exterior to that magnetic field and which experiences no acceleration other than that provided by the static magnetic field cannot subscribe to a path completely contained within that field. Charged particles are trapped into magnetic storage rings by either modifying the magnetic field while the particle is in the storage ring, by such means as a "kicker" magnet or perturbator, or by modifying the energy or trajectory of the charged particle. For instance, the synchrotron radiation emitted by high energy electrons in a large magnetic storage ring slows the particle, increasing the effective force of the magnetic field, and giving the magnetic storage ring the turning power needed to capture the electron. Kicker magnets and perturbators are used to modify the magnetic field to capture the electrons.

Another method used to capture electrons or other charged particles in a storage ring is to inject the particles from a point inside the ring. This method is used in betatrons.

Prior Art—Kicker Magnets

Electromagnets capable of changing the strength of their magnetic field quickly, often called "kicker" magnets are used to capture externally injected charged particles in a magnetic ring such as a synchrotron. For a magnetic ring of 10 meters diameter, the travel time around the ring is 100 nanoseconds. In addition, betatron oscillations will prevent the electron from returning close to its point of injection for several cycles, allowing the kicker magnet a time on the order of microseconds to switch. For small magnetic storage rings, of diameter 1 meter or less, the travel time for one orbit around the ring is on the order of 10 nanoseconds, which is makes kicker magnets prohibitively difficult and expensive to produce. The difficulty increases with decreasing radius. Examples a such systems can be found in U.S. Pat. Nos. 5,789,875, 5,216,377 and 5,001,437.

Prior Art—Perturbators

Perturbators are generally air-core coils that generate a non-linear magnetic field in the radius vector direction (see U.S. Pat. No. 5,680,018). They are similar to kicker magnets, but use a weaker field, allowing their use with smaller storage rings. Using a method called resonance injection, the perturbator is driven for a period on the order of 100 nanoseconds, allowing electron capture during this time. The perturbing field increases the betatron oscillations of injected particles, keeping them away from the point of injection for multiple orbits. When the perturbator is turned off, the beam size decreases and the betatron oscillations decrease due to radiation damping, with particles settling on a center, equilibrium orbit. The perturbator can be constructed to minimize disturbance to particles already at the equilibrium orbit. Thus, the perturbator can be pulsed again, allowing further injection, only after sufficient radiation damping to move the already injected particles away from the perturbing magnetic field. Typically this allows injection pulses at a repetition rate of 100 Hz, for a duty cycle of $10^{-9}$. This method does not allow for truly continuous injection (a 100% duty cycle) and requires, like a kicker magnet, a complex, rapid magnet pulse system.

Prior Art—Synchrotron Radiative Loss

The energy lost by an electron or other charged particle as it accelerates (turns) in the magnetic field can be used to slow the particle and allow its capture. This is in part used for resonant injection with a perturbator. However, the energy emitted by a charged particle as synchrotron radiation varies as the fourth power of the electron energy. More precisely, for electrons the energy loss due to synchrotron radiation is (D. H. Tombaoulion and P. L. Hartman, *Phys. Rev.* vol. 102, pp. 1423–46, 1956.):

$$\Delta E(\text{KeV}) = 88.5 \cdot \frac{(E_e(\text{GeV}))^4}{R(\text{meters})}$$

where ΔE(KeV) is the energy loss of the electron expressed in kiloelectron volts, $E_e$(GeV) is the initial energy of the electron in gigaelectron volts and R(meters) is the radius of the magnetic storage ring in meters. For a 1 GeV electron in a 1 meter diameter ring, the energy loss would by 88.5 KeV or a relative change of $88.5\times10^{-6}$. Although a change in energy on the order of $10^{-4}$ is small, it can be sufficient to trap an electron in a magnetic field if its initial trajectory is close to that of a closed path within the magnetic ring. However, a 100 MeV electron would experience an energy loss of 8.85 eV or approximately on part in $10^7$. This results in an unacceptably small deviation of the injection path from a closed path in the magnetic ring. For 10 MeV electrons, even using a ring of 10 cm diameter, the energy loss is 8.85 meV or approximately one part in $10^9$. Thus, synchrotron radiation is a highly inefficient braking mechanism for the capture of 100 MeV or smaller energy electrons in a magnetic storage ring. Nakayama (U.S. Pat. No. 4,988,950) describes some of the difficulties of injecting a low energy electron beam. These include that the lifetime of a low energy (40 MeV) beam is typically several minutes, which is sufficient for use with a solid radiator target, but is not compatible with the long storage times needed to build up a the large current necessary for intense synchrotron sources. Note that Nakayama uses a pulsed deflection magnet for electron beam capture.

Prior Art—Gas Damping

Electron storage rings have been proposed using a gas, such as hydrogen, to focus electrons injected into a storage ring. In addition, a thin solid target is proposed as a means of enhancing the radiation production of this device. It has been recognized that the gas and thin solid target act to dampen the electron beam, and that this damping can increase the repetition rate for resonance injection. However, resonance injection, using a perturbator with a magnetic field that turns on and off in approximately 0.1 microseconds is still required. The use of a perturbator greatly increases the cost and complexity of the system. H. Yamada, U.S. Pat. No. 5,680,018.

Prior Art—Internal Injection/betatron

One means to capture such lower energy electrons in a storage ring is to inject them from a point inside the magnetic ring. An example of this is a betatron, where electrons are injected from a point inside the radial containment field. (D. W. Kerst, Phys. Rev. vol. 60, pp.47–53, 1941; R. Kollath *Particle Accelerators* (Pitman and Sons: London) 1967. However, the requirement to inject from an internal point limits the size of the injector and thus the maximum energy of injection. The typical injection energy for betatrons is around 50 KeV. The electrons are then accelerated to higher energies by magnetic induction in the betatron. However, the efficiency of injection into the magnetic ring at energies below 1 MeV is limited by space charge effects, limiting betatrons to average of 10 $\mu$A or less, much smaller than the current available from linear accelerators, which can be on the order of mA's. Indeed, typical betatron currents are 1 $\mu$A or less. In addition, the injection into a betatron must be timed with the accelerating field, and a large time-varying magnetic field must be provided for acceleration. These requirements limit the operating frequency of a betatron to approximately 1 KHz or less. Continuous injection is not possible.

SUMMARY OF THE INVENTION

The invention uses a solid target in a magnetic storage ring to slow, and capture in a magnetic field, particles injected from a point external to the magnetic field. No magnetic pulsing system is required, and electron energies from several KeV to GeV can be captured. The braking target can also be used to produce radiation. Since the particle beam is in a storage ring, it can pass multiple times through the target, providing much greater efficiency than a single pass radiator system. As an example, a 30 MeV electron directed into a magnetic ring and passing through a 34 micron beryllium foil within this ring would lose 10 KeV of energy or 0.03%. This loss effectively increases the strength of the magnetic field by 0.03%, thus creating the same effect as a kicker magnet but in the 113 femptoseconds that it takes the electron to traverse the foil. The effective increase in magnetic acceleration allows the field of the magnetic ring to hold the electron in a closed orbit. Since only a small fraction of the electron's energy is lost on each pass through the target, it can potentially pass through the target hundreds of times.

ADVANTAGES

External injection permits many more electrons (or other charged particles) to be captured in the storage ring than is possible using internal injection, greatly increasing the intensity of radiation from the radiator target over that offered by betatrons or other internal injection methods.

The current method of external injection is passive, allowing for continual injection, rather than a limited duty cycle of pulses as for methods based on varying magnetic fields.

The current method of external injection is passive, eliminating the need for a high-speed pulsed magnet, thus reducing system cost and size and increasing reliability.

The current apparatus and method can use storage rings much smaller than one meter in diameter since particles are captured within femptoseconds. In principle, the only limit on size is the ability to construct a magnet and radiation target of a given size.

The current apparatus and method can capture electrons with energies below 100 MeV, which is very difficult using traditional methods based on synchrotron radiation, both because the synchrotron damping is insufficient and because long electron beam lifetimes (many minutes) are required to convert the electron's energy to synchrotron radiation. Lower energy electron beams are inherently less stable; however, the present invention extracts the electron's energy into radiation in a fraction of a second.

The charged particle beam can pass through the radiator multiple times, greatly increasing the radiation efficiency over that from a single pass from the injector, such as could be achieved using a linear accelerator and radiation target without the storage ring.

Much lower electron beam energies can be used. Solid targets are more efficient x-ray generators per electron than synchrotron radiation, especially at low electron beam energies. This greatly decreased the size and cost of the apparatus for a given radiation energy over that for synchrotrons or other storage ring radiation sources.

Advanced methods of radiation generation can also be used, including transition radiation, parametric radiation, Cerenkov, bremsstrahlung, coherent bremsstrahlung.

Thin braking targets can be combined with thick bremsstrahlung radiating targets to produce an intense microspot bremsstrahlung source with radiation source dimensions of 100 microns square or even smaller.

Vacuum requirements are much lower than for synchrotrons or other storage rings, since the charged particles need only pass through the target hundreds or thousands of times to convert their energy to radiation. A vacuum of 106 Torr is required rather than $10^{-10}$ Torr as for most storage rings.

The energy of the resulting radiation can be controlled by the type of radiator target used, so that the radiation energy can be chosen independent of the electron energy.

DRAWING FIGURES

DESCRIPTION OF THE PREFERRED EMBODIMENTS

Figure 1:
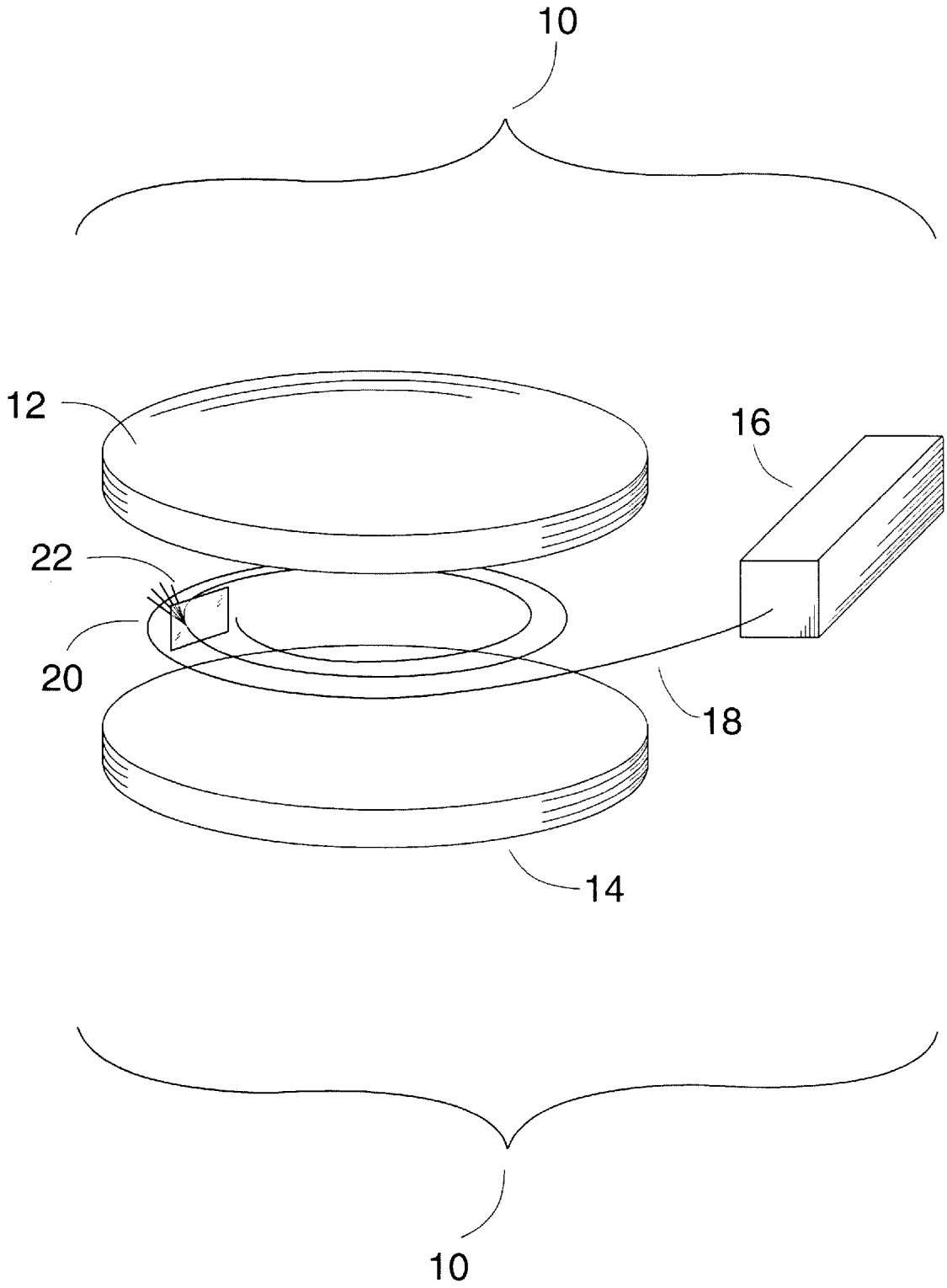
FIG. 1 shows the structure and main elements of a magnetic containment system using a beam of externally injected electrons, an embodiment of the present invention.

FIG. 1 shows external injection of an electron into a magnetic storage ring 10. The magnetic storage ring is formed by a static annular magnetic field between two blocks of magnetic material 12 and 14. The magnetic field acts to turn an electron of greater than 100 KeV energy launched from a source, 16, external to the effective magnetic field of the ring. The path of the electron, 18, forms a spiral around the axis of the magnetic ring and passes through a solid target, 20. The magnetic field is constructed so that the electron will then spiral out from the center passing through the target multiple times. The electron path is contained in a vacuum to prevent undesired energy loss to the electron. A vacuum of approximately $10^{-6}$ Torr is required for a ring 1 meter or less in diameter. The action of the electron passing through the target produces radiation 22, typically x-ray or gamma radiation.

Operation

The capture process can be described using a radial magnetic potential in the following way. The electron (or any charged particle) will experience both Lorentz and centripetal forces as its path is bent by a magnetic field. The total force experienced by the electron is always perpendicular to its path (radial for a circular orbit). For this derivation we will assume circular symmetry, though the results can be generalized to any orbit geometry for the electrons. The radial force and acceleration are describe by:

$$A_{radial} = \frac{F_{eff}}{m} = \frac{v^2}{r} - \frac{evB(r)}{m}$$

where $F_{eff}$ is the effective force on the electron (positive force is outward radially), $A_{radial}$ is the resulting radial acceleration, m is the electron mass, v the velocity of the electron, r the radius of the orbit, e the electron charge, and B(r) the magnetic field. The acceleration can be integrated to yield a radial potential $U_{radial}(r)$ that includes the effect of the electron mass and its changes.

Figure 2A:
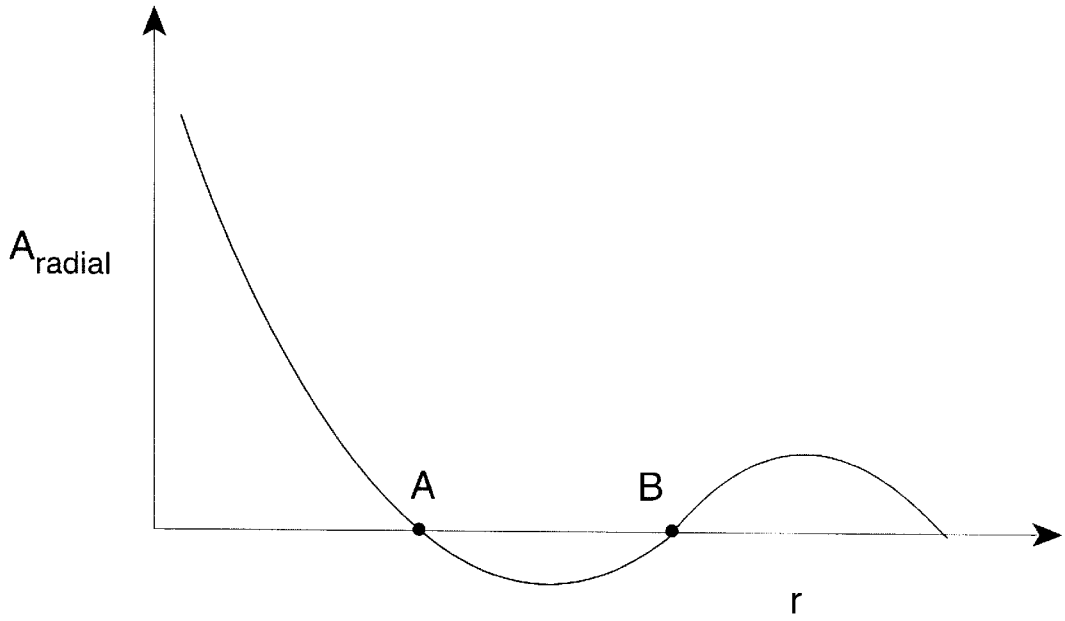
FIG. 2A shows the radial acceleration for a charged particle in a magnetic storage ring.

The capture process can be better understood by looking at a sample plot of $A_{radial}$ and $U_{radial}(r)$. FIGS. 2A and B show $A_{radial}$ and $U_{radial}$ for a hypothetical static magnetic field. The difficulty with external injection in contrast to internal injection can be seen from these figures. If a particle is injected with minimal radial velocity into the magnetic ring at point A, internal to the magnetic field, it will not escape from the potential well formed by the centripetal and magnetic forces. That is, for any radial deviation from point A, $F_{eff}$ will act to return the particle to point A. As long as the radial energy of the particle is not sufficient to rise to point B, it will be captured. However, if a particle is injected into the magnetic field from an external point, that is from a point past the capture radius, B, the particle must have a negative radial velocity (towards the center) to climb to and pass point B in the potential. The particle must have a nonzero velocity when at point B since B is an equilibrium point. But given this condition, the particle will accelerate from point B through point A; it will then be slowed by $F_{eff}$, until it comes to a stop on the left side wall at a point slightly higher than point B. The particle will then accelerate down the wall, pass through point A and pass through point B with a positive radial velocity, thus escaping the magnetic ring.

In order to capture the externally injected electron, either it must be slowed radially or the potential walls must be raised. The acceleration acting on the particle can be varied when the particle is at or near point A to increase the integral of the force between points A and B, that is, the difference in potential between points A and B. From the equation for $A_{radial}$, it is clear that an increase in the magnetic field decreases $A_{radial}$, thus increasing the potential difference between points A and B, which would make it possible to capture the particle. This has been generally the approach of the prior art for large diameter rings. However, for magnetic rings under 1 m in radius, the time available to make this change is generally on the order of 10 nanoseconds or less, which would require very fast time varying magnets, thereby being extremely expensive or even infeasible. It is the change in potential that captures the particle. For a particle with a relativistic energy ($v \approx c$, the speed of light), the energy lost through radiation, such as synchrotron radiation, or through collisions will result in a decreased effective mass while the velocity remains approximately equal to the speed of light. The decreased mass lowers the centripetal force, making it easier to contain the particle. However, synchrotron radiation does not cause a significant energy loss per orbit for electrons below 100 MeV. Using a material target allows a significant change in $A_{radial}$ and thus $U_{radial}$ even for electron energies below 100 MeV. The decrease of the electron's mass due to deceleration in a material radiator target decreases the radial acceleration increasing the area under the $A_{radial}$ curve between points A and B, thus increasing the height of the potential well. Since substantial energy (hence mass) losses can be generated by interaction with a material target, particles of any energy can be captured by the placement of a material target placed at a radius less than that of point B. In contrast, the quadratic dependence of synchrotron radiation on the particle energy limits its use for low energy particles.

Note that the radial magnetic potential, $U_{radial}$, must increase for small radii to repel the particle back toward the target from the center of the magnetic ring. This can be achieved by decreasing the strength of the magnetic field at the center of the ring.

The target used to slow the electron can also be used to generate radiation. Relativistic electrons, or other particles, travelling through a crystal or other material are known to generate radiation according to various radiation mechanisms. Such mechanisms include transition radiation, parametric radiation, Cerenkov radiation, bremsstrahlung and coherent bremsstrahlung. (M. A. Piestrup, J. O. Kephart, H. Park, R. K. Klein, R. H. Pantell, P. J. Ebert, M. J. Moran, B. A. Dahling, and B. L. Berman, "Measurement of transition radiation from medium-energy electrons," Phys. Rev. A vol. 32, pp. 917–927, August 1985. M. A. Kumakhov, Phys. Lett. vol. 57, p. 17, 1976. R. W. Terhune and R. H. Pantell, Appl. Phys. Lett. Vol. 30, p.265, 1977.

A target designed to produce radiation from one of these mechanisms will produce radiation and damp the momentum of the externally injected electron, allowing it to be captured. As the electron cycles through the magnetic ring, each time it passes through the target it will generate radiation. (U.S. patent application Ser. No. 09/148,524. and M. Yu.Andreyashkin, V. V. Kaplin, M. A. Piestrup, S. R. Uglov, V. N. Zabaev, "Increased X-ray Production by Multiple Passes of Electrons trough Periodic and Crystalline Targets Mounted Inside a Synchrotron," Appl. Phys. Letts. 72 pp. pp.1385–1387 (1998) and M. A. Piestrup, L. W. Lombardo, J. T. Cremer, G. A. Retzlaff, R. M. Silzer, D. M. Skopik and V. V. Kaplin, "Increased x-ray production efficiency from transition radiators utilizing a multiple-pass electron beam" The Review of Scientific Instruments 69, No. 6, pp. 2223–2229 (1998).) In this way, the amount of radiation from a non-circulating electron source, such as a linear accelerator, can be increased by 10 to 1000 or more times depending on the number of cycles it can make through the magnetic ring.

In one preferred embodiment, a typical electron injection energy would be about 4 MeV, and the injection angle would preferably be less than about 1 degree. Those skilled in the art will understand, however, that the angle generally needs to be somewhat tunable in order to optimize the injection. Those skilled in the art will also understand that larger angles of injection could also be used. However, in general, larger injection angles would make it more difficult to achieve the capture result. In this preferred embodiment, the two magnets provide a static annular magnetic field which is essentially zero outside a radius R of about 9.9 cm and inside a radius R of about 3.5 cm, with the field in between those two radii being given by $B=B_0/R$, where $B_0=0.1708\ \gamma$ tesla-cm. Also, a 4 micron beryllium foil would be an appropriate target. Those skilled in the art will also understand that it is useful to provide a moveable support for the target so that its position can be tuned to optimize the damping. Typically a range of about 1 cm is sufficient for the motion of the target. Those skilled in the art will also understand that the target may be cooled to avoid heat related problems, e.g. melting.

Figure 2B:
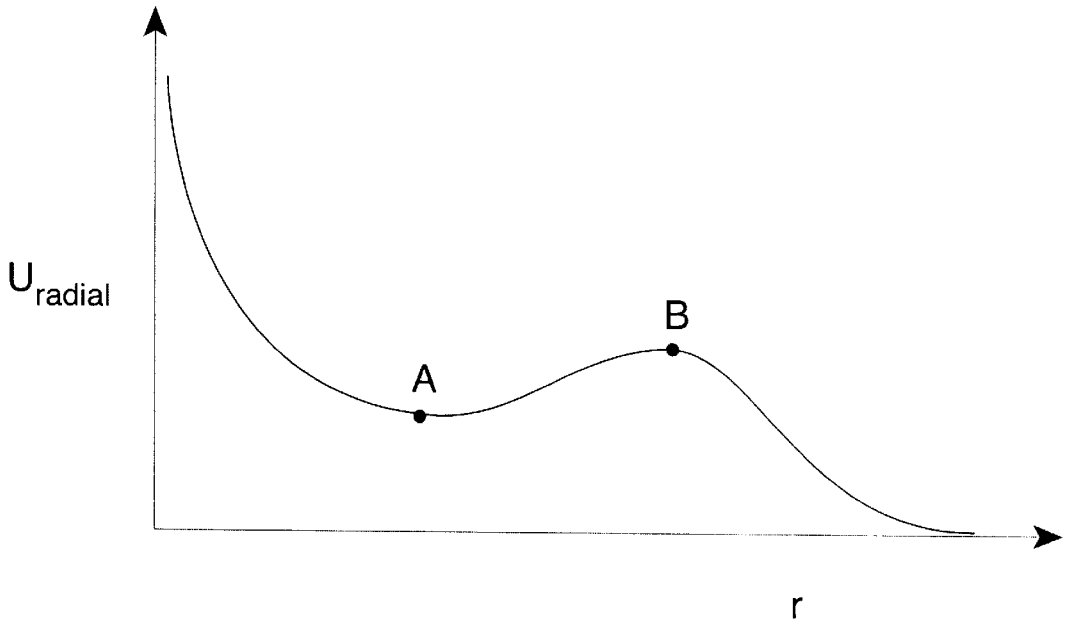
FIG. 2B shows the radial potential for a charged particle in a magnetic storage ring.
Figure 3:
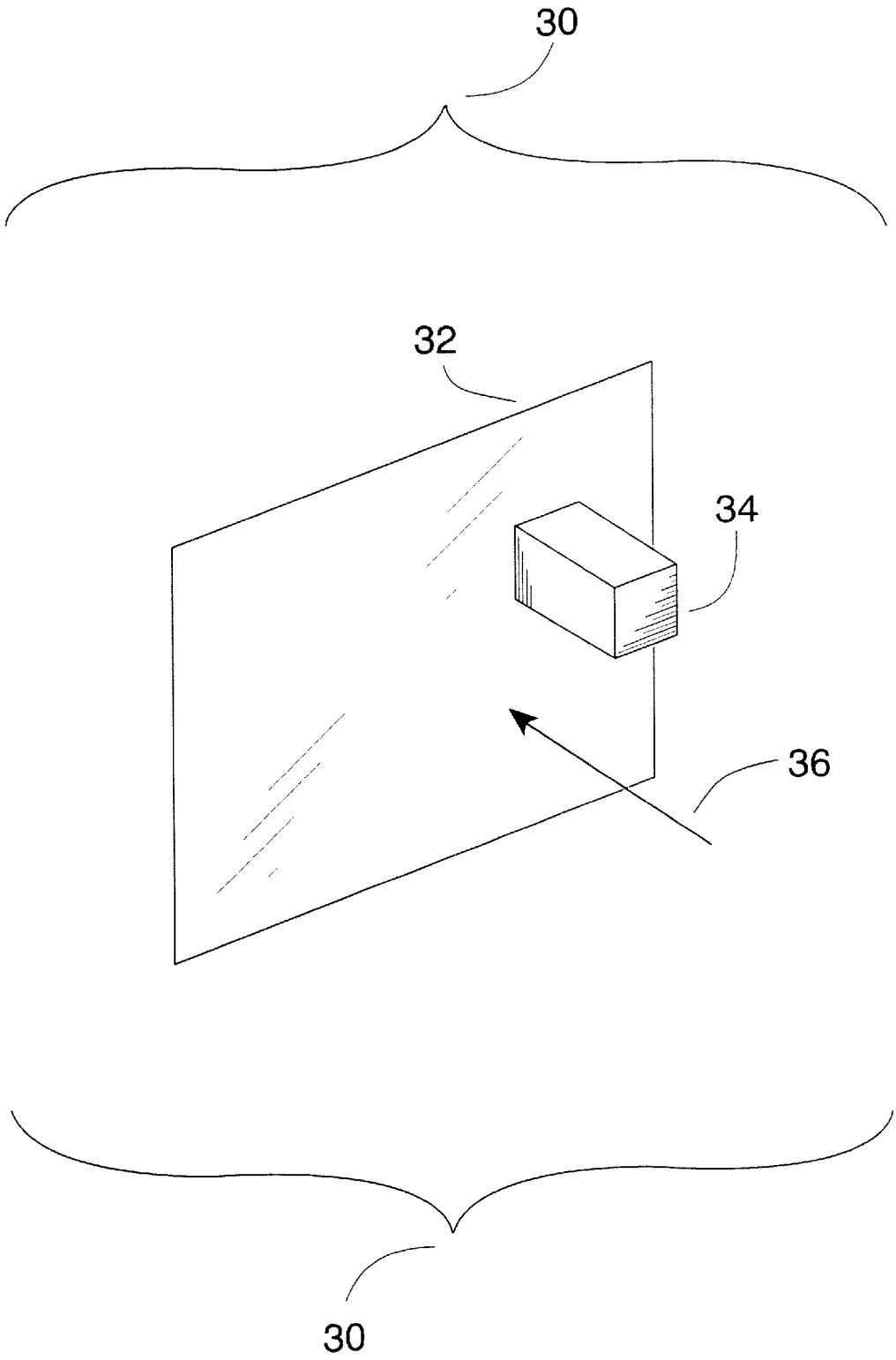
FIG. 3 shows the structure of a compound damping and radiating target for use in static magnetic storage rings.

An alternative embodiment of the present invention can be used to produce hard x-rays and gamma rays from a small source area, or microspot. The thin radiating target 20 of FIG. 2 can be replaced by a compound target, shown in FIG. 3. The compound target 30 consists of a larger area thin target 32 and a small area thick target 34. The charged particles' direction, hereafter assumed to be an electron, is also shown 36. The thin target is chosen so that it minimally slows electrons striking it. However, it must slow them sufficiently to allow capture, a condition that depends on the electron energy and parameters of the magnetic field. The area of the thin target should be large enough to provide efficient capture of externally injected electrons. The thick target is chosen to completely absorb electrons striking it. This implies that it will generally be made from high atomic number materials and will have a thickness from 100 microns to several millimeters depending on the electron energy. Electrons injected into the magnetic storage ring may strike either target. The number of times electrons will strike either target is approximately proportional to their area. Thus, if the area of the thin target is 100 times larger, it will be struck 100 times more often. However, since the electron only loses on the order of 0.01% of its energy on each pass through the thin target and 100% of its energy when striking the thick target, the intensity of radiation from the thick target will be 10–100 times more intense than that from the larger area thin target. This, in effect, creates a small spot hard x-ray source, which generates bremsstrahlung from a spot the size of the thick target. One practical design would be to have a 200 micron by 200 micron thick radiating target surrounded by a 4 square millimeter thin braking target. For a 4 MeV injected electron beam, an appropriate thick target would be Tungsten of about 100 microns in thickness, and an appropriate braking target would be beryllium of about 2–3 microns thick. Of course, many other materials may be used for either target.

CONCLUSION

The present invention provides a means for externally injecting an electron, or other charged particle, beam into a magnetic storage ring. Electron capture is affected by the damping of the electron's momentum when it strikes a solid target in the storage ring. This target serves the dual purpose of damping and producing radiation, though these functions could, in theory, be separated. The momentum damping caused by the target, decreases the mass of relativistic particles, thus increases the containing power of the magnetic field of the storage ring. Capture takes place when this extra magnetic containment force is sufficient to overcome the radial momentum of the charged particle as it approaches the edge of the containment field.

This method and the resulting apparatus can capture lower electron energies using smaller storage rings and over a greater duty cycle than is currently possible with other external injection technologies, such as those used for synchrotrons, including kicker magnets, synchrotron radiation damping, perturbators and resonance injection. In addition this invention provides a much greater captured beam current than is possible with betatrons and other internal injection accelerators. The electron beam in a storage ring can be passed through a thin target up to thousands of times, greatly increasing the radiation flux produced over that achievable from an electron source without the storage ring. This is particularly advantageous for the production of soft x-rays since the radiation production from a single pass is a small fraction of the electron's energy.

This invention could be used to construct radiation sources for industrial, scientific and medical uses including semiconductor lithography, medical imaging, x-ray diffraction, x-ray fluoroscopy, x-ray microscopy and high resolution non-destructive testing, amongst other applications. Since the size of the storage ring is only limited by the ratio of the magnetic field to the electron energy, extremely small devices are possible.

What is claimed is:

1. A magnetic storage ring system for charged particles, comprising a magnetic storage ring formed only by a static field designed to contain said charged particles, said static field comprising a static magnetic field;

an injector of relativistic charged particles located outside said static magnetic field of the storage ring, and configured to inject said relativistic charged particles into said magnetic storage ring;

a target located inside the magnetic storage ring such that said relativistic charged particles impinge on said target, said target chosen so as to decelerate the relativistic charged particles sufficiently that said relativistic charged particles are captured and circulate around said magnetic storage ring a plurality of times, wherein said relativistic charged particles are captured only by said static field.

2. A magnetic storage ring system as in claim 1 wherein said relativistic charged particles emit radiation as they decelerate in said target.

3. A magnetic storage ring system as in claim 1 wherein said static magnetic field of said magnetic storage ring results only from permanent magnets.

4. A magnetic storage ring system as in claim 1 wherein said relativistic charged particles are accelerated to energies above 0.5 MeV.

5. A magnetic storage ring system as in claim 1 wherein the relativistic charged particles pass through the target multiple times.

6. A magnetic storage ring system as in claim 1 comprising a support which holds said target, said support being moveable in order to tune said location of said target.

7. A magnetic storage ring system as in claim 1 wherein said target comprises two different targets, a damping target having a first cross-sectional area and a radiating target having a second cross-sectional area, said first cross-sectional area being much larger than said second cross-sectional area.

8. A magnetic storage ring system as in claim 1 wherein said target comprises a transition radiator.

9. A magnetic storage ring system as in claim 1 wherein said target comprises a Cherenkov radiator.

10. A magnetic storage ring system as in claim 1 wherein said target comprises a parametric radiator.

11. A magnetic storage ring system as in claim 1 wherein said target comprises a Bremsstrahlung radiator.

12. A magnetic storage ring system as in claim 1 wherein said target comprises a compound target made up of a damping target and a radiating target, wherein the damping target has a large area compared to the radiating target, and wherein the radiating target has a thick radiation length relative to the damping target.

* * * * *